United States Patent [19]

Fanning et al.

[11] 4,068,827

[45] Jan. 17, 1978

[54] PORTABLE HOIST

[75] Inventors: Larry J. Fanning; Dwight L. Duimstra, both of Sioux Falls, S. Dak.

[73] Assignee: Dwight L. Duimstra, Sioux Falls, S. Dak.

[21] Appl. No.: 700,856

[22] Filed: June 29, 1976

[51] Int. Cl.[2] ..... B66C 23/60

[52] U.S. Cl. ..... 254/139.1; 212/46 R; 214/86 R

[58] Field of Search ..... 212/17, 144, 46; 280/402 R, 47.32; 254/139.1; 214/78, 86 R, 86 A, 75 H, 450

[56] References Cited

U.S. PATENT DOCUMENTS

| | | | |
|---|---|---|---|
| 2,320,620 | 6/1943 | Tourneau | 254/139.1 |
| 2,378,605 | 6/1945 | Watson | 254/139.1 |
| 2,822,931 | 2/1958 | Sparrow | 254/139.1 |
| 3,433,459 | 3/1969 | Logan | 254/139.1 |
| 3,458,073 | 7/1969 | Dawson | 280/402 |
| 3,612,566 | 10/1971 | Sholl | 280/47.32 |
| 3,716,217 | 2/1973 | Watabe | 254/139.1 |

*Primary Examiner*—Lawrence J. Oresky

*Attorney, Agent, or Firm*—Clarence A. O'Brien; Harvey B. Jacobson

[57] ABSTRACT

A portable hoist consisting essentially of three major components readily assembled and disassembled at the job site in a relatively short period of time to facilitate portability. The three basic components include a generally horizontally disposed main frame, an elongated upright mounted at one end of the main frame and a generally horizontally extending boom at the upper end of the upright with the boom and main frame extending from opposite sides of the upright and from the upper and lower ends respectively. The main frame includes structure enabling it to be supported by wheeled units, structure to enable an end portion of the frame remote from the upright to be anchored to a supporting deck or platform such as a truck or similar vehicle, a building floor or other support and an area receiving a counterweight at a point remote from the upright. The portable hoist has particular utility in lifting preassembled house panels or sections into place by being supported from the interior house deck without need for exterior landscaping or back-filling prior to wall erection. When used on multistory buildings, the portable hoist can simply be moved to upper floors as they are completed.

6 Claims, 9 Drawing Figures

84
82
76
78
86
88
54
85
16
74
89
68
68
40
10
72
70
36
14
155
38
64
148
2
30
3
158
4
90
2
46
18
12
126
92
102
26
28
20
108
112
124
96
3
4

104
10
18
12
155
148
90
126
36
30
38
150
152
124
50
158
120
5
5
34
18
154
22
22
108
96

8
58
160
156
160
54
78
80
74
155
8
68
38
42
62
64
66

86
58
60
68
56
76
38
89
78
74
16
80
68
36

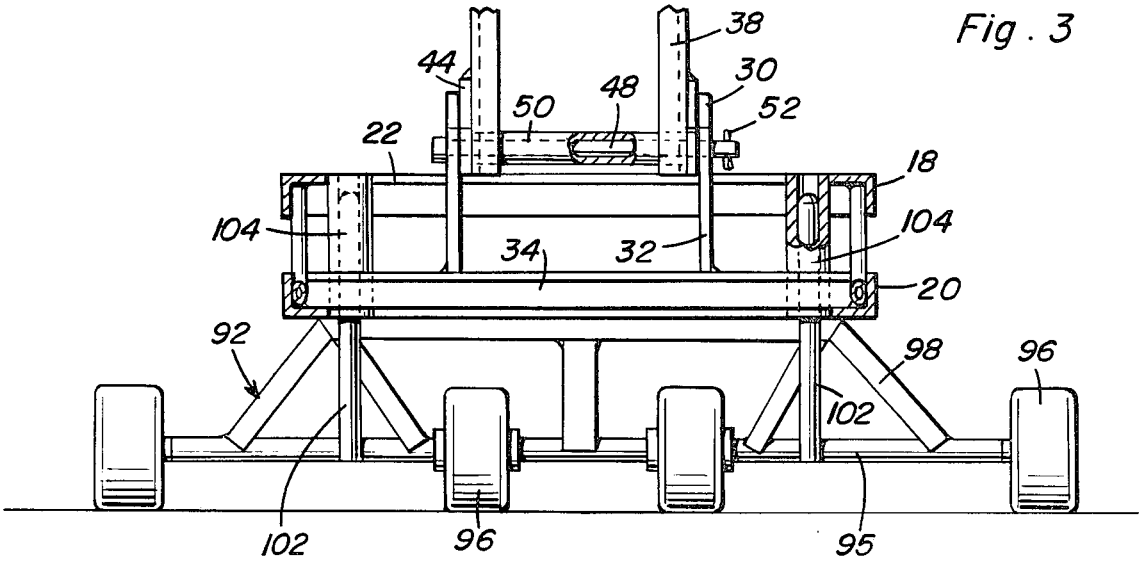
Fig. 3
Fig. 4
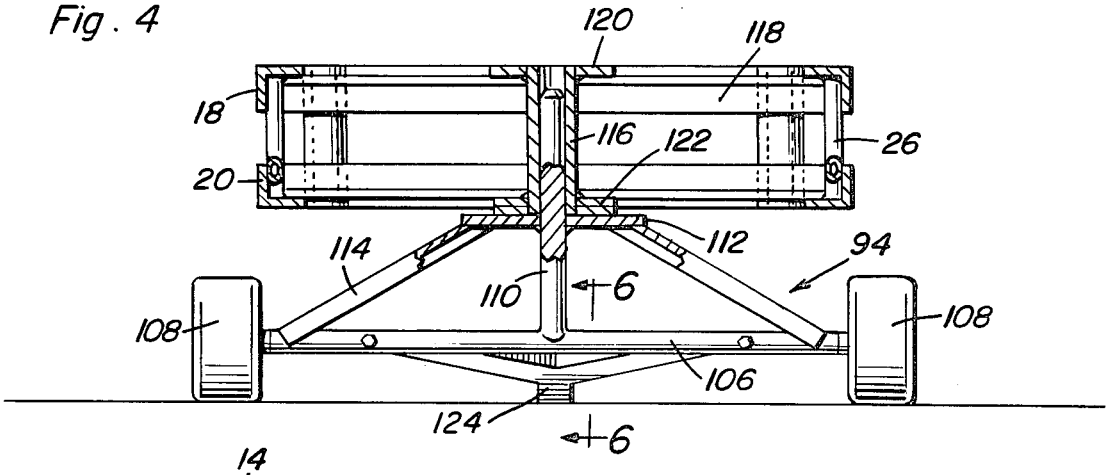
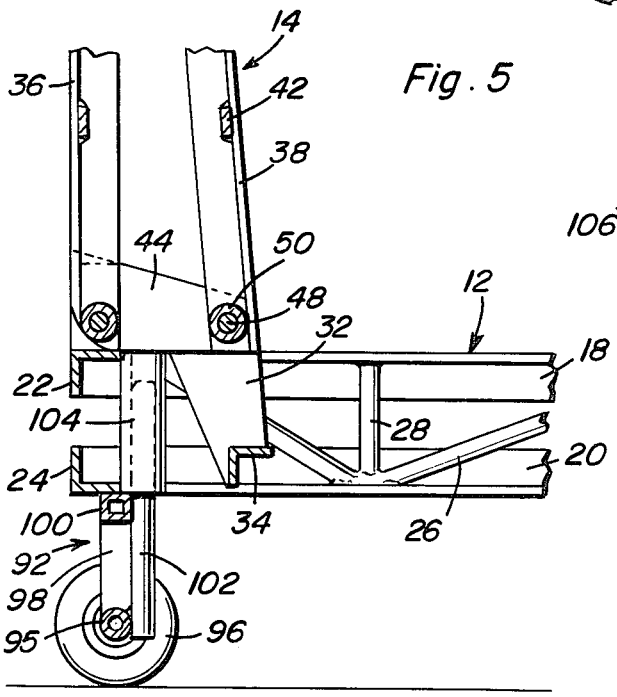
Fig. 5
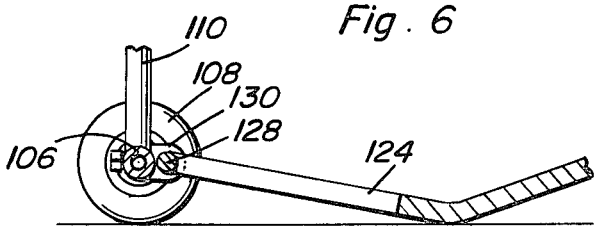
Fig. 6
Fig. 9
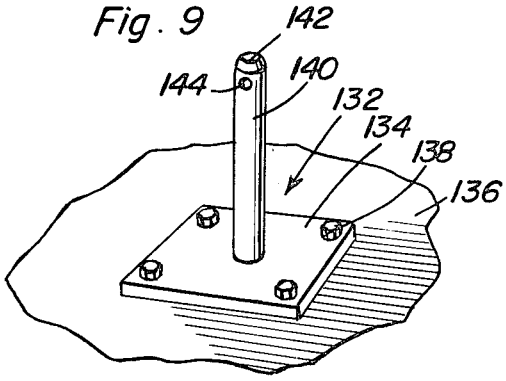

PORTABLE HOIST

BACKGROUND OF THE INVENTION

1. Field of the Invention

The present invention generally relates to a hoist structure and more particularly a hoist constructed of three basic components releasably connected to each other to facilitate assembly and disassembly and to facilitate portability of the hoist to a job site in a disassembled and collapsed or knocked-down position and then being readily set up or assembled at the job site with the main frame or base component including structural features to facilitate support thereof on a supporting surface, deck, platform or the like, connection to a truck bed and support by wheeled units.

2. Description of the Prior Art

Many devices have been provided for use in lifting loads such as overhead cranes employed in many industrial plants and mobile cranes used in many construction operations and other uses with such devices usually including an elongated boom supported in an upwardly inclined position and provided with a flexible cable entrained over a pulley at the outer end of the boom and provided with a load-engaging structure at the free end thereof and connected with a winch drum at the end of the boom connected to the vehicle on which the boom is mounted. Such mobile cranes are quite expensive and due to their weight and cumbersome nature, they are usually moved to a job site by the use of a trailer type vehicle. Other hoisting devices of lightweight construction are also known with some of these devices being foldable or collapsible, vehicle mounted and the like. Representative of the prior patents illustrating developments in this field of endeavor are U.S. Pat. Nos. 1,798,456, 2,340,351, 2,491,357, 2,509,435 and 3,450,386.

SUMMARY OF THE INVENTION

An object of the present invention is to provide a portable hoist including three basic components which are detachably connected to each other to facilitate assembly at the job site and disassembly for ease of transport to another location in which the components include a main frame or base generally horizontally disposed, an upright at one end of the frame and a boom at the upper end of the upright in which the boom and frame extend in opposite directions from the upright.

Another object of the invention is to provide a portable hoist in accordance with the preceding object in which the main frame is provided with a structure to enable the connection of wheeled units at each end thereof with one of the wheeled units being steerable and provided with means for connection with a tow handle to enable manual manipulation of the hoist.

A further object of the invention is to provide a portable hoist in accordance with the preceding objects in which the main frame is also provided with a structure to enable it to be connected to a support surface either by placing it directly on the surface and employing counterweights to prevent tilting movement or by providing an upstanding anchor peg on the support surface for connection with the main frame.

Still another object of the present invention is to provide a portable hoist in accordance with the preceding objects in which each of the basic components is of truss construction and the connection between the components is in the form of removable pins which enables the components to be easily assembled and disassembled in a very short period of time with the entire structure being relatively inexpensive to manufacture, easy to transport and capable of many uses.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a transverse, sectional view, on an enlarged scale, taken substantially upon a plane passing along section line 3—3 of FIG. 1 illustrating further structural details of the wheeled unit at the front of the hoist in underlying relation to the upright.

FIG. 4 is a transverse, sectional view, on an enlarged scale, taken substantially upon a plane passing along section line 4—4 of FIG. 1 illustrating the rear steerable wheeled unit and the construction thereof which enables it to be connected to the main frame in remote relation to the upright.

FIG. 5 is a fragmentary, longitudinal sectional view, on an enlarged scale, taken substantially upon a plane passing along section line 5—5 of FIG. 2 illustrating the structural details of the connection between the main frame and upright.

FIG. 6 is a fragmentary sectional view illustrating further structural details of the steerable wheeled unit.

FIG. 9 is a fragmental perspective view of a supporting pin for anchoring the rear of the frame to a truck load bed or other supporting platform.

DESCRIPTION OF THE PREFERRED EMBODIMENTS

Figure 1:
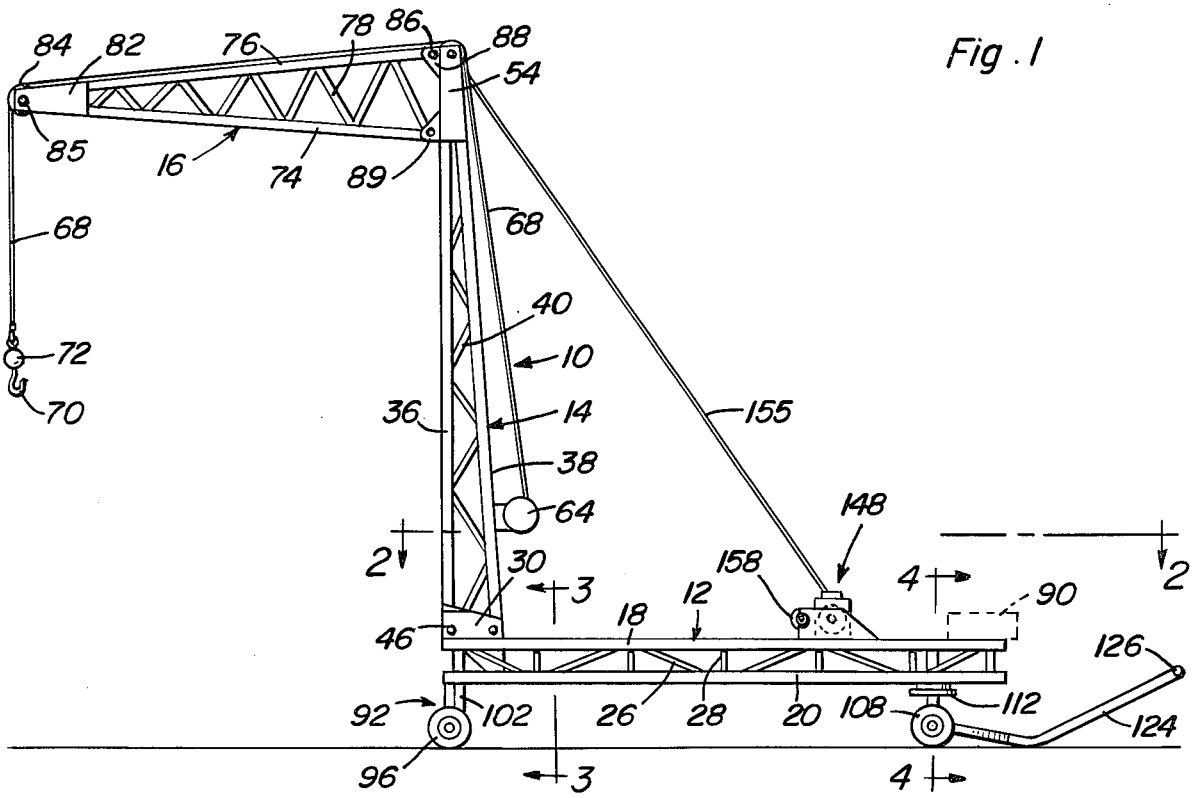
FIG. 1 is a side elevational view of the portable hoist of the present invention with wheeled units connected thereto.
Figure 2:
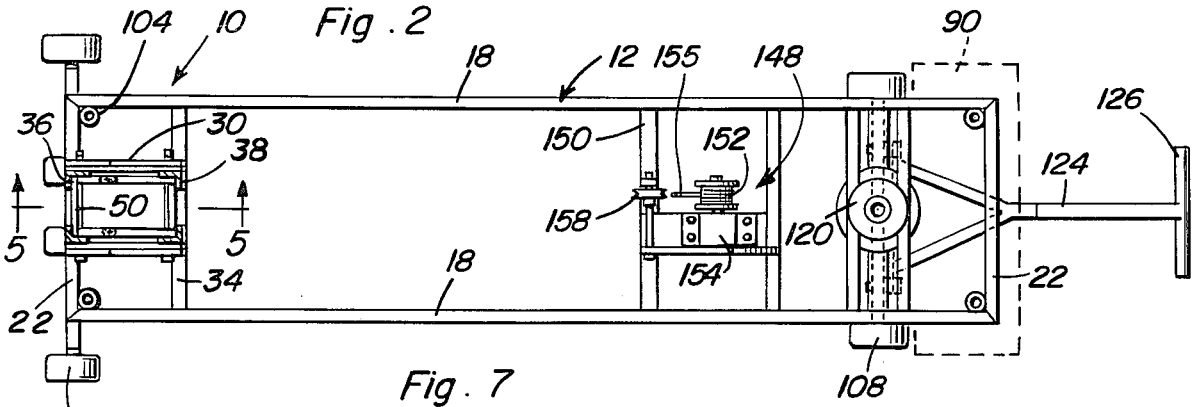
FIG. 2 is a plan view of the lower portion of the hoist taken substantially upon a plane passing along section line 2—2 of FIG. 1 illustrating the structural details of the main frame and the relationship of the wheeled unit thereto.

Referring now specifically to the drawings, the portable hoist of the present invention is designated by reference numeral 10 and is illustrated in side elevational relationship in FIG. 1 and includes three basic parts or components. The three basic components include a generally horizontally disposed main frame or base 12 of truss construction and of rectangular configuration as illustrated in FIG. 2 with an upright 14 mounted at one end thereof and extending generally vertically therefrom with the upright end of the frame being the front end and the end of the frame remote therefrom being the rear with it being pointed out that this nomenclature is arbitrary and used for the purpose of description of the invention. At the upper end of the upright, a boom 16 is supported with the boom being generally horizontally disposed but extending from the upright in a direction opposite to the main frame 12 with both the upright and the boom also being of truss construction.

The main frame 12 includes upper and lower side rails 18 and 20 which are parallel to each other and spaced from each other and preferably are in the form of angle irons which are interconnected at their ends by parallel upper and lower end rails 22 and 24. The side rails 18 and 20 at each side of the frame are interconnected by angulated truss members 26 and vertical truss members 28 rigidly affixed to the rails 18 and 20 to provide a rigid frame. The forward end of the frame 12 includes a pair of upstanding, parallel mounting plates 30 which extend above the frame 12 and are disposed laterally inwardly from the side edges thereof. The rear end portions of the plates 30 depend downwardly at 32 and are fixedly secured to a transverse rail 34 secured to and extending between the lower side rails 20 as illustrated in FIG. 5.

The upright 14 includes a pair of forward rails 36 and a pair of rearward rails 38 which converge upwardly toward the rails 36 and are rigidly spaced therefrom by angulated truss members 40. The rails 36 are maintained in rigid parallel relation to each other and the rails 38 are maintained in rigid parallel relation to each other by transverse brace members 42 thus providing a rigid truss structure with the lower end of the upright including a pair of plates 44 rigidly affixed thereto with the plates 44 being disposed inwardly of the mounting plates 30 and in close proximity thereto as illustrated in FIG. 4. The plates 30 and 44 have a pair of aligned apertures or holes extending therethrough at 46 for receiving mounting pins 48 therethrough. As illustrated in FIGS. 3 and 5, the pins 48 also extend through a tubular member 50 extending between the interior surfaces of the rails 36 and 38. The plates 44 are reinforcements for the lower end of the boom and the two pins 48 are removably secured in position by any suitable means such as by one end of the pin being headed or larger and the other end being provided with a removable transverse key or pin 52. Thus, by the use of two pins 48, the upright 14 may be easily assembled on the frame or detached therefrom. The upper end of the upright is provided with a pair of plates rigidly affixed thereto on the exterior of the rails 36 and 38 with a shaft or rod 56 extending through the plates 54 and journaling a pulley or sheave 58 thereon in a position generally centrally of the upper end of the boom with spacers 60 being provided on the shaft 56 to properly retain the pulley 58 in position on the shaft 56. Supported on the rear of the upright 14 is a winch drum 62 driven by a suitable motor such as an electric motor 64 both of which are supported on a mounting plate 66 fixed to the rails 38. The winch drum 62 has a lifting cable or line 68 wound thereon which is entrained over the pulley 58 and then extends forwardly along the upper surface of the boom 16 and downwardly over the front of the boom 16 as illustrated in FIG. 1 with the free end of the lifting cable 68 including a hook 70 or other means for connecting to a load together with a weight to maintain the lifting cable 68 generally in taut condition so it will not become entangled when it is being unwound from the winch drum without a load thereon.

Figure 7:
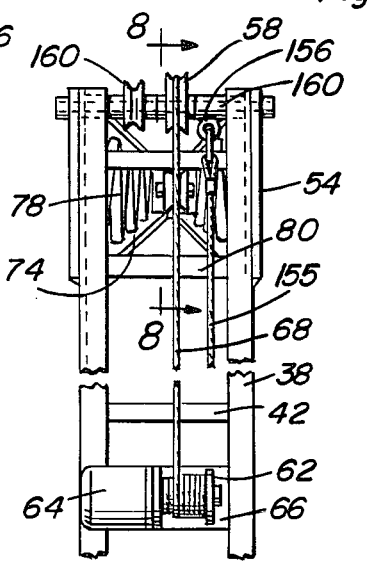
FIG. 7 is a fragmentary rear elevational view of the upper end portion of the upright and boom illustrating the winch construction for the lifting cable.
Figure 8:
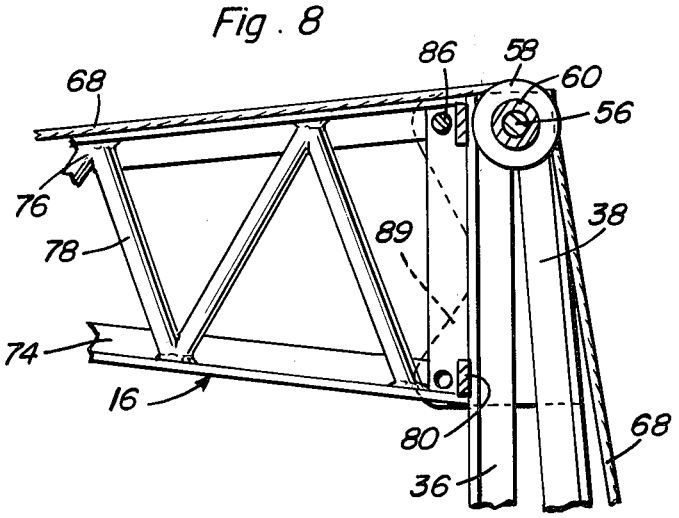
FIG. 8 is a fragmentary sectional view taken substantially upon a plane passing along section line 8—8 of FIG. 7 illustrating the specific structural details of the connection between the upper end of the upright and the boom and the manner in which the pulley or sheave for the lifting cable is supported.

The boom 16 includes a pair of lower side rails 74 and a pair of upper side rails 76 which are rigidly interconnected by angulated brace members 78 extending between the rails 74 and 76 and by transverse brace members 80 between the rear end portions of the lower rails 74 and the rear end portions of the upper rails 76 as illustrated in FIG. 8. The rails 74 and 76 converge towards each other as illustrated in FIG. 1 and the rails 76 converge towards each other and the rails 74 converge towards each other as illustrated in FIG. 7. The outer ends of the rails 76 and 74 are interconnected by side gusset plates 82 having a pulley 84 journaled therebetween and mounted on a shaft 85 extending through the plates 82 thus forming a support for the lifting cable 68 with the pulley 84 being in alignment with the pulley 58 so that operation of the electric motor 64, which is reversible, will lower or raise the hook 70 for lifting a load. The inward or rear end of the boom 16 is attached to the upper end of the upright by a transverse pin 86 which extends through the end portions of the upper rails 76 and forwardly projecting lugs 88 on the gusset plates 54. The bottom rear corner of the boom 16 rests against the forward edge surfaces of the forward rails 36 and plates 54 at the upper end of the upright 14. This arrangement stabilizes the boom 16 but enables disassembly of the boom 16 by merely removing a pin 86 and the upright 14 may be removed by removing the two pins or rods 48 so that the three components, generally equal in overall length, can be supported in parallel relation to each other and the upright and boom positioned on top of the main frame thereby providing a compact unit which can be easily transported to a job site while in disassembled condition and then readily assembled at the job site. A pair of lugs 89 on the lower front of plates 54 are aligned with openings in the lower rails 74 to receive pin 86 when removed to enable boom 16 to fold down to a position alongside the upright 14. The lower surface of the frame 12 is generally planar and is capable of being positioned on any supporting deck, house floor or other supporting surface with the rear end of the upper surface of the frame being unobstructed so that counterweights 90 can be placed thereon to stabilize the frame and prevent the load being lifted by the hook 70 from tilting the hoist. The various rails, braces, truss members and the like are rigidly secured together such as by welding or any other suitable means and may be constructed of any suitable material having the requisite physical properties such as strength, weight, and the like.

To provide mobility to the hoist, a front wheeled unit 92 is provided to support the front end of the main frame 12 and a rear, steerable wheeled unit 94 is provided to support the rear of the main frame 12. The front wheeled unit 92 includes an elongated rigid front axle 95 which extends beyond the side edges of the frame as illustrated in FIG. 3 and includes four wheels 96 journaled thereon which may be of any standard construction but preferably have a relatively wide tread face. Upstanding from and rigid with the axle 95 is a plurality of brace members 98 the outer of which are inclined and the center being vertical with the brace members being rigidly interconnected by a top member 100 which underlies and engages the lower frame rails 20 as illustrated in FIGS. 3 and 5. Rigidly affixed to each end of the top member 100 and depending to and rigidly affixed to the axle 95 is a vertical rod or pin 102 in which the two rods or pins 102 are parallel to each other as illustrated in FIG. 3 and which extend above the top member 100 a distance slightly less than the vertical height of the frame 12. The two forward inner corners o the frame 12 include a tubular sleeve 104 rigidly affixed thereto, such as by welding or the like with the sleeves 104 telescopically and slidably receiving the upper ends of the pins or rods 102 which are slightly rounded to facilitate insertion of the pins 102 into the sleeve 104. Thus, the front wheeled unit 92 is securely and rigidly secured in supporting relation to the frame 12 but the frame 12 may be readily detached therefrom by lifting the frame 12 upwardly from the wheeled unit 92. If desired, the length of the pins 102 could be extended and project above the frame 12 with suitable transverse fastening pins being used to secure the frame to the wheeled unit 92 so that it would remain attached to the frame 12 in the event the frame 12 is lifted from its supporting surface.

The rear wheeled unit 94 includes a rigid axle 106 having a supporting wheel 108 at each end thereof which are spaced apart a distance less than the outermost front wheels 96 as illustrated in FIG. 4. Centrally of the axle 106 is an upstanding rod or pin 110 which extends vertically upwardly through a turnable 112 which is rigidly braced by inclined braces 114. The upper end of the pin 110 is telescopically received in a tubular sleeve 116 rigidly affixed to the frame 12 by transverse members 118 paralleling the upper and lower end rails with the upper and lower end of the sleeve 118 including circular plates 120 and 122 respectively with the circular plate 122 being in surface-to-surface engagement with the turntable 112 thus forming a pivot axis for the rear wheeled unit 94 so that it may pivot about a central vertical axis to steerably control the movement of the portable hoist along a supporting surface. In order to move the hoist, an elongated handle or tongue 124 is attached to the axle and provided with a transverse free end portion 126 by virtue of which the rear wheeled unit may be steerably controlled and the hoist pushed or pulled. The handle or tongue 124 may be secured to the axle for pivotal movement about a transverse axis as by pins or bolts 128 extending through lugs 130 rigid with the axle 106 or by any other suitable means. The pin 110 could also be made longer to extend above the sleeve 116 and be provided with a transverse keeper or pin to secure the rear steerable wheeled unit 94 to the frame 12 even when the frame 12 is lifted. However, the wheeled units may be easily assembled with the frame to render the frame portable depending upon the particular requirements of the job site.

FIG. 9 illustrates an anchoring assembly 132 including a plate 134 secured to a supporting surface 136 which may be the load bed of a truck, pickup truck or the like by suitable bolts 138 or the like with the plate 134 including an upstanding pin or rod 140 which is adapted to be received in the sleeve 116 in the same manner as the pin 110 is received therein. The upper end of the pin 140 is tapered as at 142 and provided with a transverse aperture 144 for receiving a keeper pin or fastener so that the pin 140, being longer than the sleeve 116, will serve to anchor the frame to the truck load bed, pickup body or any other supporting surface on which the pin 140 is anchored. This will provide an anchorage for the frame 12 so that it will be secured to a supporting surface such as a house floor, deck, dock, truck bed or any other desired surface.

Another option which can be employed is the use of a trailer hitch having a ball socket at the end thereof for connection to a vehicle for towing the device. The trailer hitch would include upstanding pins or pegs similar to the pins 102 which can be inserted into tubular sleeves 146 at the rear corners of the frame as illustrated in FIG. 2 so that by using a trailer hitch in lieu of the rear wheeled unit 94, the hoist may be towed behind any type of vehicle having a ball hitch member at the rear thereof. Also mounted on the frame 12 is a winch assembly 148 supported on cross members 150 and including a winch drum 152 and motor 154. A cable 155 is connected to winch drum 152 and extends and connects with an eye bolt or ring 156 on spacer 60 or frame rail 38 at the upper end of the upright 14. This cable is used to erect the upright 14 and boom 16 and also transmits load forces from boom 16 to the rear portion of the main frame 12 thereby reducing shear forces exerted on pins 48 which connect the upright 14 to the frame 12. The frame 12 is also provided with a pulley 158 which can be used in conjunction with pulley 160 on shaft 56 when lifting heavier loads. In this arrangement the cable 155 from ring 156 is entrained over pulley 158 then over pulley 160 to winch drum 152 so that the tension load is supported by multiple cable strands. The winch motors 64 and 154 are reversible electric motors and other suitable power devices may be employed if desired. Electric brakes may be provided for the winch motors as is conventional and if desired, drive wheels may be provided on either of the wheeled units to power the device from one location to another if desired. The front wheel assembly may include a staggered four wheel arrangement so that 2 of the wheels would be maintained on a floor joist at all times. The structural components of the frame, upright and boom may be changed to take advantage of weight and cost factors as desired. For example, tubular members and connector plates may be used and additional trusses may be added where required.

The hoist is capable of many uses but one of its principal uses is the lifting of pre-assembled house sections or panels into place from the interior house deck without any need for back-filling or otherwise providing a supporting area externally of the house. If a multistory building is being constructed, the hoist can simply be moved to another floor and loads lifted. The hoist may be assembled or disassembled in a very short time, usually less than 10 minutes, and the three basic components facilitate the portability of the hoist. The total weight of the hoist is maintained at a minimum but can be varied along with the size of the lifting cable and other components and the cost of the device is relatively low with the device being quite simple in construction and easy to assemble but yet dependable and long lasting.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A portable hoist comprising a generally elongated, rectangular, horizontally disposed frame having a substantially planar bottom surface, an elongated upright mounted on one end of said frame and extending upwardly therefrom, an elongated boom mounted at the upper end of the upright and extending generally horizontally, said boom and said frame extending in opposite directions from the upright, winch means mounted on said hoist and including a lift cable entrained over a pulley at the outer end of the boom, means on the free end of the lift cable for engaging a load, said upright being detachably connected to said frame by removable pin means, and removable pin means connecting the boom to the upper end of the upright, said winch means including a winch drum and motor mounted on the upright adjacent the lower end thereof, a pulley mounted on the upper end of the upright in alignment with the winch drum for receiving the lifting cable with the lifting cable being wound on said winch drum, a wheeled unit mounted in underlying relation to each end of the frame to enable the frame to be moved from one location to another, one of said wheeled units being steerable for guiding movement of the hoist, the wheeled unit adjacent the end of the frame to which the upright is connected including a rigid axle journaling more than two wheels along a single axis and lying in parallel planes, upstanding support pins rigid with the axle and terminating in upper ends extending above a horizontal member rigidly spaced above said axle, said frame including a pair of vertical sleeves rigidly mounted in the corners of said frame at one end thereof and telescopically and detachably receiving the pins for mounting the wheeled unit below the frame.

2. The structure as defined in claim 1 wherein the other wheeled unit is located adjacent the opposite end of the frame and includes a rigid axle with at least one wheel journaled therefrom, said axle including a turntable and upstanding pin, said turntable being in the form of a plate disposed below the upper end of the pin, said frame including a centrally located vertical sleeve adjacent the end of the frame remote from the upright receiving said pin with the sleeve including a bottom plate journaled against the turntable plate to enable the axle to pivot about a vertical axis, and a tongue member connected with the axle to enable steering control of the frame and to enable the frame to be pushed or pulled to a desired location.

3. The structure as defined in claim 2 wherein the end of the frame remote from the upright includes a horizontally disposed surface receiving counterweight means to prevent the hoist from tilting when a load is lifted.

4. The structure as defined in claim 3 wherein said frame, upright and boom are of truss construction with one end of the frame including a pair of laterally spaced upstanding plates receiving the lower end of the upright therebetween, the lower end of the upright including laterally and longitudinally spaced members interconnected by a pair of transverse sleeves, and a pair of pins extending through the plates and sleeves on the lower end of the upright with the pins being horizontally disposed and longitudinally spaced in relation to each other along the length of the frame, said boom tapering outwardly from the upright, said upright including a pair of laterally spaced plates at the upper end thereof receiving the upper corner portion of the end of the boom therebetween with a removable pin extending through the plates and upper corner portion of the boom for detachably connecting the boom to the upright, the lower corner of the boom freely resting against the surface of the upright for stabilizing the boom.

5. The structure as defined in claim 4 wherein said frame includes a winch means mounted thereon in remote spaced relation to the upright for facilitating the assembly of the upright and boom to the frame to enable transport of the hoist in a knocked down condition and subsequent assembly at the job site, and a cable extending from the upper end of the upright to the winch means on the frame and defining the hypotenuse of a right triangle in which the legs thereof are generally equal in length and defined by the upright and frame to transmit forces from the upper end of the upright to the frame.

6. A portable hoist comprising a generally elongated, rectangular, horizontally disposed frame having a substantially planar bottom surface, an elongated upright mounted on one end of said frame and extending upwardly therefrom, an elongated boom mounted at the upper end of the upright and extending generally horizontally, said boom and said frame extending in opposite directions from the upright, winch means mounted on said hoist and including a lift cable entrained over a pulley at the outer end of the boom, means on the free end of the lift cable for engaging a load, said upright being detachably connected to said frame by removable pin means, and removable pin means connecting the boom to the upper end of the upright, said frame including a centrally disposed sleeve at the end of the frame remote from the upright with the sleeve being rigid on the frame, anchoring means for engagement with the sleeve for anchoring the frame against a generally planar supporting surface, said anchoring means including an upstanding pin telescopically received in the sleeve and including a transverse aperture in the upper end thereof adapted to receive a retaining fastener, flat plate means on the lower end of the pin to be fastened to a truck load bed or other supporting surface in order to secure the pin to a truck load bed or other supporting surface for anchoring the frame to prevent tilting of the hoist when a load is lifted.

* * * * *